United States Patent [19]

Isobe et al.

[11] 4,342,520

[45] Aug. 3, 1982

[54] INKRIBBON FEED MECHANISM

[75] Inventors: Minoru Isobe; Makoto Shimizu; Shigemi Hagiwara, all of Tokyo, Japan

[73] Assignee: Oki Electric Industry Co., Ltd., Tokyo, Japan

[21] Appl. No.: 131,110

[22] Filed: Mar. 18, 1980

[30] Foreign Application Priority Data

Mar. 29, 1979 [JP] Japan ..... 54-036264

[51] Int. Cl.[3] ..... B41J 33/44

[52] U.S. Cl. ..... 400/221; 400/221.2; 400/231; 400/233

[58] Field of Search ..... 400/221, 221.2, 231, 400/233, 229, 218; 242/67.4

[56] References Cited

U.S. PATENT DOCUMENTS

| | | | |
|---|---|---|---|
| 584,497 | 6/1897 | Eckels | 400/221 X |
| 1,949,107 | 2/1934 | Mosfelt et al. | 400/221.2 X |
| 2,902,136 | 9/1959 | Whippo . | |
| 3,726,381 | 4/1973 | Murphy | 400/233 X |
| 3,786,906 | 1/1974 | Okabe . | |
| 3,954,167 | 5/1976 | Krantz et al. | 400/221.2 |
| 4,182,576 | 1/1980 | Fujimori et al. | 400/221 |

FOREIGN PATENT DOCUMENTS

| | | | |
|---|---|---|---|
| 2529055 | 1/1977 | Fed. Rep. of Germany | 400/221 |
| 2737096 | 3/1979 | Fed. Rep. of Germany | 400/221 |

OTHER PUBLICATIONS

IBM Technical Disclosure Bulletin, vol. 20, #2, Jul. 1977, "Gear Drive Ribbon Reversing Mechanism."

Print Mechanism Ribbon Feed, Bernard, IBM Technical Disclosure Bulletin, vol. 7, No. #3, 8/64.

*Primary Examiner*—Steven A. Bratlie

*Attorney, Agent, or Firm*—Berger & Palmer

[57] ABSTRACT

An inkribbon feed mechanism is disclosed which feeds the inkribbon by utilizing power of a spacing motor by which a print head is transversed. The inkribbon feed mechanism comprises commanding means which detect a command element for reversing the inkribbon near one end of the inkribbon, an arm member which interlocks with the command means via a spring member and is pivotably supported by a pivot, a planetary gear member which is provided at one end of the arm member and is rotated by the power of the spacing motor via a drive gear member. In compliance with the alternate rotation of the spacing motor, the planetary gear member engages with a gear member of one reel or is slightly moved in orbit by the drive gear member so as not to render a rotational force to the reel. The arm member is pivoted by the command means to change the object which the planetary gear engages.

6 Claims, 6 Drawing Figures

INKRIBBON FEED MECHANISM

BACKGROUND OF THE INVENTION

A. Field of the Invention

The present invention relates to an inkribbon feed mechanism of a printer or more particularly to the inkribbon feed mechanism which feeds the inkribbon by utilizing power of a spacing motor by which a print head is traversed.

B. Description of Prior Art

In a wire impact printer, for example, the so-called open reel system, the inkribbon is stretched between a pair of spaced reels on the left and right sides of the printer. The inkribbon is fed to a printing position between a print head and a platen. To achieve an improved printing quality, the inkribbon should be exactly fed in accordance with the movement of the print head which traverses from the left to the right side of the printing width. In addition, when the inkribbon from the supply side of the reel is exhausted, the direction of the inkribbon should be quickly reversed so that the empty reel may take up the inkribbon in the open reel system.

In the prior art, motors are provided for each reel on the left and right sides for feeding the inkribbon, or a motor exclusively for feeding the inkribbon is equipped for rotating a reel. For reversing the inkribbon, the motor is rotated in the reverse direction and contact with a gear member is changed. But, with the first scheme, the cost for production is raised because two motors are needed for feeding the inkribbon. In accordance with the latter scheme, the direction of the motor should be kept until command means, such as an eyelet appears from the reel. Moreover, the direction should be kept in memory when an electric source of the printer is turned off. For these reasons, the prior art mechanism is complex and expensive.

SUMMARY OF THE INVENTION

From an economical standpoint of view, it is wasteful to provide a motor exclusively for feeding the inkribbon. On the other hand, it is suitable to utilize a spacing motor by which the print head is traversed for feeding the inkribbon. However, the print head alternates a printing action, traversing from the left to the right side of the printing width, and a returning action, traversing from the right to the left side of the printing width. In accordance with these actions, the spacing motor frequently changes its direction of rotation by turns. Accordingly, it is necessary to feed the inkribbon regardless of the direction of rotation of the spacing motor for utilizing it. In addition, the direction of the inkribbon should be quickly changed when the inkribbon comes to its end in open reel system.

Accordingly, it is an object of the invention to obtain a simple and economical inkribbon feed mechanism. It is another object of the invention to provide the inkribbon feed mechanism which utilizes the spacing motor. It is further object of the invention to provide the inkribbon feed mechanism by which the inkribbon is fed to the take up side regardless of the rotation of the spacing motor. It is other object of the invention to provide the inkribbon feed mechanism by which the direction of the inkribbon is quickly changed when it comes to its end.

To achieve these objects, the inkribbon feed mechanism according to the present invention comprises commanding means which detect a commanding element such as an eyelet for reversing the inkribbon near one end of the inkribbon, an arm member which interlocks with the commanding means via a spring member and is pivotably supported by a pivot, a planetary gear member which is provided at one end of the arm member and is rotated by a power of the spacing motor via a drive gear member and, in accordance with the alternate rotation of the spacing motor, the planetary gear member engages with a gear member of one reel or is slightly moved in orbit by the drive gear member so as not to render a rotational force to the reel, and the arm member is pivoted by the commanding means to change the object with which the planetary gear engages.

The above and further objects and novel features of the invention will more fully appear from the following detailed description when the same is read in connection with the accompanying drawings. It is to be expressly understood, however, that the drawings are for purpose of illustration only and are not intended as a definition of the invention.

DETAILED DESCRIPTION OF THE INVENTION

Figure 1:
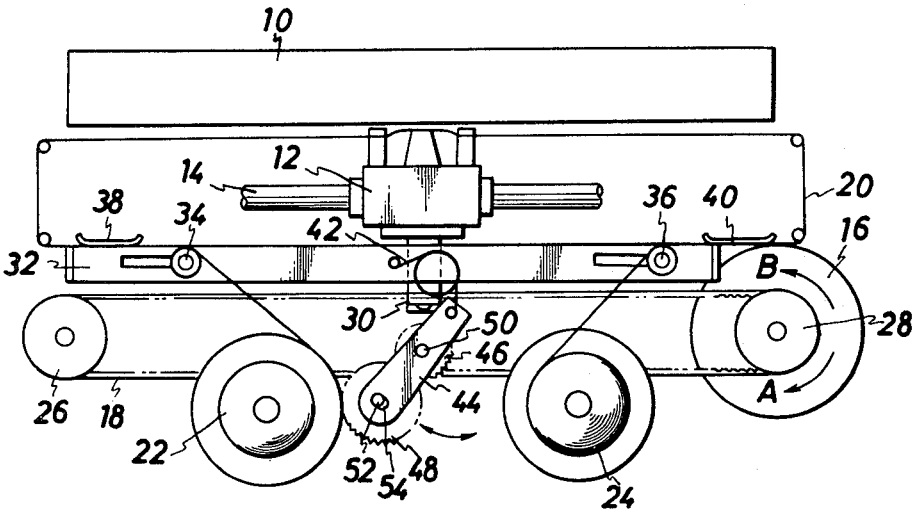
FIG. 1 is a schematic illustration showing an embodiment of inkribbon feed mechanism according to the present invention.

Referring now to FIG. 1, a printer of an open reel type system is schematically shown. In the figure, numeral 10 indicates a platen, numeral 12 indicates a print head, numeral 14 indicates a guide shaft, numeral 16 indicates a spacing motor, numeral 18 indicates a timing belt, numeral 20 indicates an inkribbon, numerals 22 and 24 indicate reels for supplying and taking up the inkribbon 20. Print head 12, is for example, a wire impact type and is traversed by a drive force of the spacing motor 16 on the guide shaft 14. The print head 12 performs a printing action when it traverses from the left to the right side on the guide shaft 14. On the contrary, the print head 12 returns to its original position when it traverses from the right to the left side, to the original position, and printing action is not carried out. For printing a paper (not shown) which is provided between the platen 10 and the inkribbon 20, the print head strikes on the inkribbon 20. The spacing motor 16 and the timing belt 18 are provided for traversing the print head 12. The rotation of the spacing motor 16 can be alternated in the A or B directions by a command signal which is generated when the print head 12 reaches the left or right end of the printing width. The rotational force of the spacing motor 16 is transmitted to the timing belt 18 which is stretched between pulleys 26, 28 and the timing belt 18 is shifted between the pulleys 26, 28 in compliance with the rotation of the spacing motor 16. A plate member 30 is provided for connecting the timing belt 18 to the print head 12. The plate member 30 transmits the movement of the timing belt 18 to the print head 12 in order to traverse it on the guide shaft 14. The inkribbon 20 which is taken up or is supplied by reels 22, 24 is fed to the print position between the print head 12 and the platen 10 with a predetermined tension force. For designating the reel to be rotated and rendering the rotational force to the reel, mechanisms according to the present invention are provided and will be described hereinunder.

In FIG. 1, numeral 32 indicates a reversing bar, numerals 34 and 36 indicate guide rollers, numerals 38 and 40 indicate guide plates, numeral 42 indicates a spring member, numeral 44 indicates an arm member, numeral 46 indicates a drive gear member and numeral 48 indicates a planetary gear member. The reversing bar 32 can be traversed along the guide rollers 34, 36. The transverse movement of the bar 32 is effected as described below. At one end of the inkribbon 20 of the open reel system, a command element for reversing the inkribbon 20, such as an eyelet (not shown), is attached. When the supply side of the inkribbon 20 is exhausted and the command element is put between a turn back of the bar 32 and one of the guide plates 38, 40, the bar 32 traverses to the direction of the inkribbon 20. The action of the bar 32 is transmitted to the arm member 44 via the spring member 42, which may be a detent spring. The spring member 42 is for biasing the arm member 44, which is pivotally supported around a pivot 50 in compliance with the movement of the bar 32. The arm member 44 is, as described, pivotable around the pivot 50 and supports the drive gear member 46 which is coaxial with the pivot 50 and the planetary gear member 48 at the opposite end of the spring member 42. The drive gear member 46 engages with the planetary gear member 48 and interlocks with the timing belt 18 by way of a gear member (not shown). By these provisions, the rotational force of the spacing motor 16 for traversing the print head 12 can be transmitted to one of the reels 22, 24 via the timing belt 18 and the planetary gear member 48. A pivot 52 of the planetary gear member 48 is inserted in an oblong hole 54 at one end of the arm member 44 and the planetary gear member 48 can be slightly moved in orbit along the oblong hole 54 as well as being rotated by the drive gear member 46.

Figure 2:
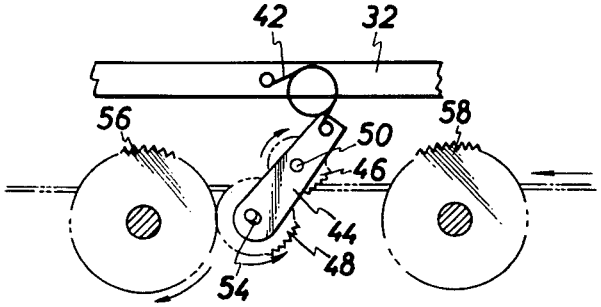
FIG. 2 is an illustration in which a planetary gear member is engaging with a gear member of one reel.
Figure 3:
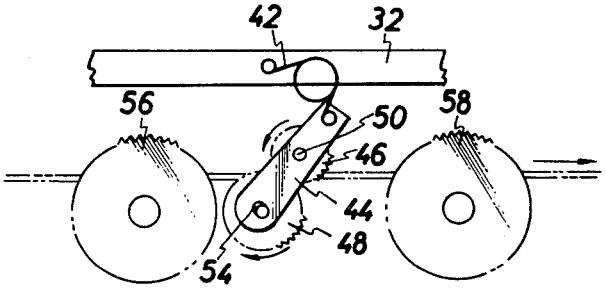
FIG. 3 is an illustration in which the planetary gear member is disengaged from the gear member by slightly moving in orbit.
Figure 4:
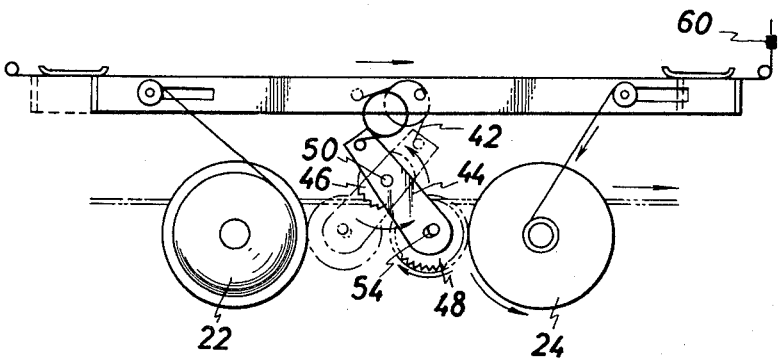
FIG. 4 is an illustration in which a direction of the inkribbon is reversed by changing an object with which the planetary gear engages in compliance with a pivot motion of an arm member.

In the next place, the operation of the mechanism will be described hereinunder with reference to FIGS. 2 to 4. In the following descriptions, the print head 12 effects printing, traversing from the left to the right side of the printing width when the spacing motor 16 rotates in the A direction. In this case, the drive gear member is rotated in the clockwise direction by the timing belt 18 and the planetary gear member 48 is rotated in the counterclockwise direction. On the contrary, when the spacing motor 16 is rotated in the B direction, the print head 12 returns to its original position by traversing from the right to the left side of the printing width. In this case, the drive gear member 46 rotates in the counterclockwise direction and the planetary gear member 48 rotates in the clockwise direction. Assuming that the planetary gear member 48 engages with a gear member 56 of the left reel 22, as shown in FIG. 2, the drive gear member 46 rotates in the clockwise direction, while the planetary gear member 48 rotates in the counterclockwise direction when the spacing motor 16 rotates in the A direction. Thereupon, the gear member 56 of the left reel 22 rotates in the clockwise direction and the inkribbon 20 is then taken up by the reel 22. In conclusion, the print head 12 traverses from the left to the right, effecting a printing action, and the inkribbon 20 moves from the right to the left at the printing position. When a line of printing is finished, the print head 12 should be returned to the left side of the printing width. For this reason, the spacing motor 16 rotates in B direction. According to the rotation of the spacing motor 16, the drive gear member 46 rotates in the counterclockwise direction by the timing belt 18. In accordance with the counterclockwise rotation of the drive gear member 46, the planetary gear member 48 rotates in the clockwise direction and moves slightly in orbit. Thereupon, the planetary gear member 48 is disengaged from the gear member 56, as shown in FIG. 3. Though the arm member 44 is biased by the spring member 42, the biasing range is restricted within narrow limits around the pivot 50. The planetary gear member 48 at one end of the arm member 44 slightly moves in orbit so that it is disengaged from the gear member 56 upon influence of the drive gear member which rotates in the counterclockwise direction. Thereupon, the reel 22 loses its rotational force and the inkribbon 20 is not advanced. In summary, the inkribbon 20 is not advanced when the print head 12 returns to its original position so that the inkribbon 20 is not wasted. Even when the arm member 44 is biased toward the gear member 56, the inkribbon 20 is taken up by the left reel 22 with the aid of the spacing motor 16 which rotates in the A direction. When the inkribbon 20 of the supply reel 24 comes to its end, the commanding element, such as an eyelet is utilized. The commanding element is caught by the turn back at the right end of the reversing bar 32. Then, the bar 32 moves in the right direction until the commanding element is released. Following the movement of the bar 32, the arm member 44 which is pivotably supported around the pivot rotates in the counterclockwise direction by the spring member 42. And then, the gear member 58 of the right reel 24 comes into engagement with the planetary gear member 48.

The progress will be detailed hereinunder how the object to which the planetary gear engages is changed by the rotation of the arm member. Let us assume that the spacing motor 16 rotates in the A direction and the inkribbon 20 of the right reel 24 is exhausted and, moreover, the print head is traversing from the left to the right. In this case, the frictional force between the gear member 56 and the planetary gear member 48 overcomes the biasing force of the spring member. Therefore, the printing of the line is continued until the direction of the spacing motor 16 is changed to the B direction, with the left gear member 56 being engaged with the planetary gear member 48. When the printing is finished and the direction of the spacing motor 16 is changed to the B direction, the arm member 44 is rotated by the spring member 42 and, as shown in FIG. 4, the planetary gear member 48 comes in engagement with the gear member 58 of the right reel 24. Numeral 60 indicates the command element.

In the next place, the relationship between the direction of the spacing motor 16 and the inkribbon 20 will be described after the planetary gear 48 comes into engagement with the right gear member 58. When the spacing motor 16 rotates in the B direction and the print head 12 returns to its original position, the drive gear member 46 rotates in the counterclockwise direction by the timing belt 18. Thereby, the planetary gear member 48 engages with the right gear member 58 to rotate it in counterclockwise direction and the inkribbon 20 is taken up. In summary, the inkribbon 20 advances from the left to the right when the print head 12 returns to its original position. On the contrary, the drive gear member 46 rotates in clockwise direction by the timing belt 18 when the spacing motor 16 rotates in the A direction. Thereupon, the planetary gear member 48 slightly moves in orbit along the oblong hole 54 and the member 48 is disengaged from the right gear member 58. That is, the inkribbon 20 does not move when the timing belt 18 rotates in A direction and the print head 12 effects printing. In FIG. 2, the inkribbon 20 is fed while printing, whereas the inkribbon is advanced only when the print head 12 is returning to its original position in FIG. 4. In this way, the inkribbon 20 is successively taken up by the right reel 24 and, when the command element of the left reel 22 is caught by the turn back of the bar 32, the bar 32 moves in the left direction, thereby the arm member 44 rotates around the pivot 50 by way of the spring member 42. Thereupon, the object with which the planetary gear member 48 engages is changed to the left gear member 56. As described, the inkribbon feed mechanism according to the present invention comprises commanding means such as the reversing bar which is actuated by detecting the commanding element at one end of the inkribbon, the arm member which interlocks with the commanding means via the spring member such as the detent spring and is pivotably supported around its pivot, the planetary gear member which is provided at one end of the arm member and is rotated by the power of the spacing motor via the drive gear member. In compliance with the alternate rotation of the spacing motor, the planetary gear member engages with the gear member of one reel or is slightly moved in orbit by the drive gear member so as not to render the rotational force to the reel. The arm member is pivoted by the commanding means to change the object with which the planetary gear engages. By these provisions, the power of the spacing motor can be utilized for feeding the inkribbon. In addition, the inkribbon feed mechanism can be simplified in construction and offers a considerable advantage as to the cost of production. The present invention is also applicable to the printer in which the printing is effected when the print head moves both in the right and the left direction.

Figure 5:
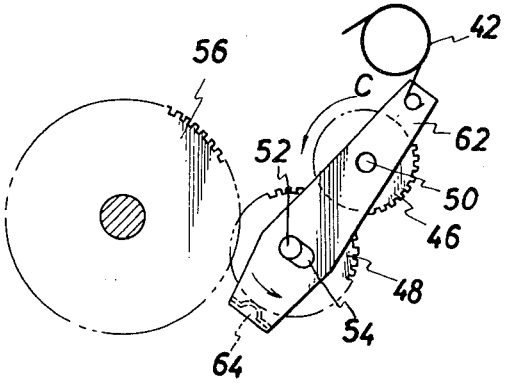
FIG. 5 is a partial plan view showing another embodiment of the present invention.
Figure 6:
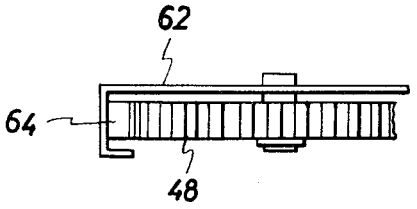
FIG. 6 is a side elevational view of FIG. 5.

By the way, it is desirable that the planetary gear member may be quickly disengaged from the reels when the direction of the print head is changed. FIGS. 5 and 6 show an embodiment for this purpose. In these figures, a forward end of an arm member 62 is extended to beyond the periphery of the planetary gear member 48. A platelike friction member 64 is provided at the inside of the extended arm member 62. The friction member 64 is always in contact with the planetary gear member 48. But, the frictional force is not so strong that the rotation of the planetary gear member 48 is obstructed. When the drive gear member 46 rotates in the C direction under the condition that the planetary gear member 48 engages with the left gear member 56, as shown in FIG. 5, the planetary gear member 48 slightly moves clockwise in the oblong hole 54 of the arm member 44, and the member 48 is quickly disengaged from the gear member 56 with the aid of the frictional force of the member 54.

While there have been shown and described and pointed out the fundamental novel features of the invention as applied to the preferred embodiments. It will be understood, however, that the various omissions and substitutions and changes may be made by those skilled in the art without departing from the spirit of the invention.

What is claimed is:

1. An inkribbon feed mechanism for an open reel type printer, the inkribbon feed mechanism comprising a reversible spacing motor, a timing belt connected to said spacing motor to be driven thereby to move said printer, said printer printing as it moves from left to right across the width of the printer, a take-up reel and a supply reel, control means coupled between said timing belt and said take up and supply reels to cause movement of said inkribbon under control of said take up and supply reels selectively, said control means controlling said supply reel to move said inkribbon when said printer is moving from left to right and said spacing motor is rotating in one direction, said control means disengaging said timing belt from being coupled to said supply reel to halt movement of said inkribbon as said printer moves to its return position from right to left, said control means comprising means to sense when said inkribbon reaches each end of said inkribbon, said control means comprising means responsive to sensing that said inkribbon is at one end to shift said control means to couple said timing belt to said take-up reel to control movement of said inkribbon by driving said take-up reel, said inkribbon being moved by said take-up reel as said printer returns to its original print position, wherein said control means comprises a pivotable arm having a pivot point, one end of said pivotable arm having an oblong slot in which a planetary gear is rotatably connected thereto, said take-up and supply reels each comprising respective gear members driven by said planetary gear to drive each respective reel, said spacing motor rotating in one direction as said planetary gear is coupled to said gear member of said supply reel, a control drive gear connected to said pivotable arm at the pivot point of said pivotable arm and being coupled to said timing belt, said control drive gear coupled to said planetary gear, said spacing motor reversing its direction when the printer reaches its far right position causing said timing belt to reverse its direction and move said planetary gear in said oblong slot decoupling from said gear member of said supply reel.

2. An inkribbon feed mechanism according to claim 1 wherein a friction member is provided at one end of said pivotable arm in order to apply brakes to the rotation of said planetary gear so that said planetary gear is quickly disengaged from the gear member of the supply reel.

3. An inkribbon feed mechanism as set forth in claim 1, wherein said control means further comprises a command element located near one end of an inkribbon and a command means responsive to said command element to terminate rotation of one of said reels upon sensing said command element.

4. An inkribbon feed mechanism as claimed in claim 1, wherein said control means comprises a reversing bar connected to said pivotable arm through a spring member, said reversing bar being driven in one direction when said control means senses the inkribbon is at one end and being driven in the opposite direction when said inkribbon is sensed being at its other end, said spring member being moved by said reversing bar to move said pivotable arm to couple said planetary gear to either of said gear members for said take-up and supply reels.

5. An inkribbon feed mechanism as claimed in claim 4, wherein the force of said spring member moving said pivotable arm is less than the force exerted on said pivotable arm by said planetary gear being engaged with said gear members so that said printer continues to print until the end of a line when said spacing motor reverses direction after said control means senses that either end of said inkribbon has been reached, said spring member thereafter moving said pivotable arm to engage the other of said gear members.

6. An inkribbon feed mechanism as claimed in claim 5, wherein said spring member is biased to urge said pivotable arm to engage one of said reels.

* * * * *